US007931550B2

(12) United States Patent
Lynch

(10) Patent No.: US 7,931,550 B2
(45) Date of Patent: Apr. 26, 2011

(54) PROGRAMMABLE LIGHTED ARCHERY NOCK

(75) Inventor: David M. Lynch, Walworth, NY (US)

(73) Assignee: Grace Engineering Corp., Memphis, MI (US)

( * ) Notice: Subject to any disclaimer, the term of this patent is extended or adjusted under 35 U.S.C. 154(b) by 431 days.

(21) Appl. No.: 12/249,210

(22) Filed: Oct. 10, 2008

(65) Prior Publication Data

US 2009/0098959 A1 Apr. 16, 2009

Related U.S. Application Data

(60) Provisional application No. 60/998,362, filed on Oct. 10, 2007, provisional application No. 61/080,905, filed on Jul. 15, 2008.

(51) Int. Cl.
*F42B 6/06* (2006.01)

(52) U.S. Cl. ..... 473/578; 473/570

(58) Field of Classification Search ..... 473/570, 473/578, 585, 586

See application file for complete search history.

(56) References Cited

U.S. PATENT DOCUMENTS

| | | | | |
|---|---|---|---|---|
| 5,134,552 | A | 7/1992 | Call et al. | |
| 5,141,229 | A * | 8/1992 | Roundy | 473/570 |
| 6,390,642 | B1 | 5/2002 | Simonton | |
| 6,758,773 | B1 * | 7/2004 | Liao et al. | 473/578 |
| 7,316,625 | B2 | 1/2008 | Takahashi | |
| 7,837,580 | B2 * | 11/2010 | Huang et al. | 473/570 |

OTHER PUBLICATIONS

Photographs of Firenock taken Oct. 6, 2008.
Firenock website, http://www.firenockintl.com, downloaded on Oct. 7, 2008.

* cited by examiner

*Primary Examiner* — John Ricci
(74) *Attorney, Agent, or Firm* — Warner Norcross & Judd LLP

(57) ABSTRACT

The present invention generally relates to a lighted archery nock. The lighted archery nock generally includes an accelerometer, a replaceable battery, a light, a housing, and a microprocessor that controls illumination of the light. The microprocessor can control the timing of the light to save battery life and respond to user input transmitted by tapping the nock to re-set the light. The housing is configured with a plurality of fingers that interact with the replaceable battery to hold it in place.

19 Claims, 6 Drawing Sheets

PROGRAMMABLE LIGHTED ARCHERY NOCK

This application claims the benefit of U.S. Provisional Application 60/998,362 filed Oct. 10, 2007, which is hereby incorporated by reference. This application also claims the benefit of U.S. Provisional Application 61/080,905 filed Jul. 15, 2008, which is hereby incorporated by reference.

BACKGROUND OF THE INVENTION

The present invention relates to archery arrow nocks with a light-emitting feature, commonly referred to as illuminated or lighted nocks.

Tracing the flight of an arrow in low light conditions, such as those found at dawn and dusk, is difficult and often impossible. There are a variety of approaches attempting to address this issue, many of which use arrows including illuminated nocks that can be seen in low light. Two examples of conventional illuminated nock technology are illustrated in U.S. Pat. No. 6,390,642, to Simonton, and U.S. Pat. No. 7,316,625 to Takahashi.

Simonton discloses an illuminated arrow nock that is activated by a magnetic field. The arrow nock includes a normally open magnetic reed switch connected to a battery, circuitry, a light and a riser magnet that must be mounted to a riser of a bow from which the arrow is shot. When the arrow is shot, the normally open magnetic reed switch passes through the magnetic field of the riser magnet, which closes the magnetic reed switch, which completes the circuit between the battery and the light to illuminate the light. The circuitry also includes a capacitor which discharges to eventually interrupt the circuit between the battery and the light after a predetermined amount of time. The circuitry can also include a processor that pulses or blinks the light after being actuated by the reed switch. Although Simonton provides an illuminated nock, it provides added complexity and opportunity for system failure by requiring the nock to pass through the magnetic field of the riser magnet. Further, due to the light automatically de-powering after a programmed amount of time, archers sometimes must search for the arrow under pressure, knowing that the light may soon de-power.

Takahashi discloses an illuminated nock that includes an electrical circuit that has a normally open acceleration switch, a capacitor circuit, a battery and an LED. The acceleration switch includes two thin metal plates, which are separated by a distance. When the arrow is shot from a bow, the thin plates bend and contact one another, thereby completing the circuit between the battery and the LED to light the LED and charge the capacitor circuit. After the arrow reaches constant speed, the metal plates separate so power is no longer provided from the battery to the LED. The capacitor, however, continues to provide its charge to the LED. After a predetermined amount time, however, the charge of the capacitor is depleted, and the LED de-powered. Like Simonton, due to the light automatically de-powering after a predetermined amount of time, archers sometimes must search for the arrow under pressure, knowing that the light may soon de-power.

Although the nocks of the above references provide desired illumination, they suffer the noted shortcomings. In addition, while these references include holders for the related batteries, these holders sometimes may not adequately retain the battery, and may also render battery replacement very difficult, which is unappealing to consumers.

SUMMARY OF THE INVENTION

The present invention provides an archery arrow nock including an accelerometer, a power source, a light and an optional controller that controls the illumination of the light. In an embodiment, the controller can be a microprocessor that performs one or more functions, such as: monitoring the accelerometer, controlling the timing of the light emitting cycle of the light, and responding to input by a user, for example, to reset the light.

In one embodiment, the archery nock is joined with an arrow adapted for shooting from an archery bow. The archery nock includes an accelerometer, which can be a mechanical acceleration switch and/or an integrated circuit accelerometer. The accelerometer can be actuated by accelerating the arrow, for example, when the arrow is shot from the archery bow. The accelerometer can generate or provide a signal or accelerometer output indicative of the acceleration of the arrow or arrow nock to the microprocessor. As a result, the microprocessor illuminates the light as a function of the accelerometer output, for example by completing a circuit between the battery and the light. Optionally, the power source can be a DC-DC power supply, such as a lithium battery, and the light can be a light emitting diode (LED), filament light, or other light source.

In another embodiment, the microprocessor can account for a phenomenon referred to as a "blind spotting", which results when the nock is illuminated immediately upon release of the arrow, causing the archer to be temporarily blinded by that illumination in the corner of the eye. Optionally, the microprocessor can illuminate the light after a predetermined time interval after release of the arrow to prevent blind spotting.

In yet another embodiment, the microprocessor can PWM (Pulse Width Modulate) the LED to conserve battery life by turning it on and off at a frequency that is not perceptible to the human eye. The rate or other variables of the PWM can be controlled as a function of the accelerometer output. Optionally, the microprocessor or circuitry can be programmed or wired to minimize battery drain, thereby improving battery life.

In a further embodiment, the lighted nock assembly can receive input from a user. This input can be transferred through the accelerometer and/or another sensor associated with the nock. The accelerometer or other sensor can detect acceleration or deceleration along axes other than the longitudinal axis of the nock, which is generally aligned with the longitudinal axis of an arrow. The microprocessor can respond to this information to perform the user's desired functionality. Accordingly, when a user moves the nock, for example, taps the nock against an object, the accelerometer or other sensor can detect this movement, and send a signal to the microprocessor. The term tap is used to convey moving the arrow nock in a direction other than longitudinal with the arrow and does not require the arrow or arrow nock assembly to touch another object—mere movement of the arrow or arrow nock assembly sufficient to register an accelerometer output in a direction other than generally longitudinal with the arrow is sufficient. The microprocessor, upon detecting the signal, can operate the light of other components of the nock.

The microprocessor may be programmed to respond to the accelerometer output in a variety of different ways. For example, depending on the amount of deceleration or acceleration detected by the accelerometer, the microprocessor may be programmed to do one or more of the following: turn off the light, turn on the light, blink the light, blink the light fast, blink the light slow, pulse width modulate the light to save battery power, blink the light at a predetermined speed or range of speeds, blink the light after the arrow stops so an archer can find the arrow, or operate the light or other archery nock component in some other way.

The microprocessor may also be programmed to recognize successive accelerometer output. For example, in some embodiments, the microprocessor can recognize and distinguish between one, two, three or more taps of the arrow nock and perform a different function in response to each. The microprocessor can recognize the number of taps by identifying a particular pattern in the accelerometer output. In one embodiment, predefined time intervals and thresholds allow identification of successive taps of the arrow.

In an alternative embodiment, the microprocessor may be programmable by tapping the nock. A particular number of successive taps can prompt the controller to enter a programming mode. During the programming mode, the user can program the nock to perform whatever functionality the user desires. For example, the user can program the microprocessor to perform specific functions in response to one, two, three or more taps. In one embodiment, upon entering programming mode, the microprocessor is pre-programmed with a number of different functionalities that the user may select. For example, the programming mode may allow the user to determine the speed at which the light blinks by having the light blink at a range of different speeds until the user taps the nock, where tapping the nock selects the current speed of blink. Other characteristics that may be programmed include, but are not limited to, brightness of the light, blindspot time, shutoff time, and any other programmable lighted archery nock variable.

In yet a further embodiment, the microprocessor can be programmed to cause the light to blink perceptibly at some predetermined time after arrow launch, and then turn it off after another predetermined time to conserve the power source, for example, the life of a battery. Optionally, instead of blinking perceptibly at some predetermined time after arrow launch, the microprocessor can be programmed to cause the light to blink perceptibly in response to determining that the arrow has come to a rest. Optionally, the microprocessor can be programmed to monitor the accelerometer and prevent false activation of the light if the arrow is accidentally dropped. In one embodiment, the predetermined time may be programmed in the field by the user using the programmable mode described above.

In another, further embodiment, the power source can be a battery, and the battery can be replaceable relative to the nock. For example, the nock can include circuitry, such as a circuit board to which the other components, such as the accelerometer, microprocessor and light are joined. The circuit board can include contacts or terminals which engage the battery. The nock can also include a housing or other element that engages the battery to ensure that the battery maintains contact with the circuit board terminals or contacts. Optionally, the battery can include an annular groove, and the housing can include tabs that engage the annular groove on the battery. The annular battery groove can include any annular recess or any other battery interface that interfits with the housing tabs. The housing tabs can include fingers or any other housing interface that interfits with the battery annular groove. Optionally, an "O" ring or other spacer can be placed on a peripheral surface of the battery to facilitate centering the unit in the inside diameter of the arrow shaft.

In yet another further embodiment, the circuit board may be constructed with tabs or projections extending from it where the two are adapted to engage the arrow nock and/or the battery housing. Optionally, the tabs can be included on edges of the board. The tabs can engage corresponding holes, such as slots, in the housing. In still another, further embodiment, the nock can be constructed with internal projections that define one or more slots which engage the edges of the circuit board. Optionally, the edges can be retained with an adhesive, such as silicon. Further optionally, a nock with a smooth internal bore can be used. There, retention can be achieved by a device inserted through holes aligned in the nock and the circuit board, such as a pin. Even further optionally, an adhesive can be applied to provide retention of the pin or other device.

These and other objects, advantages, and features of the invention will be more fully understood and appreciated by reference to the description of the current embodiment and the drawings.

DESCRIPTION OF THE CURRENT EMBODIMENT

Figure 1:
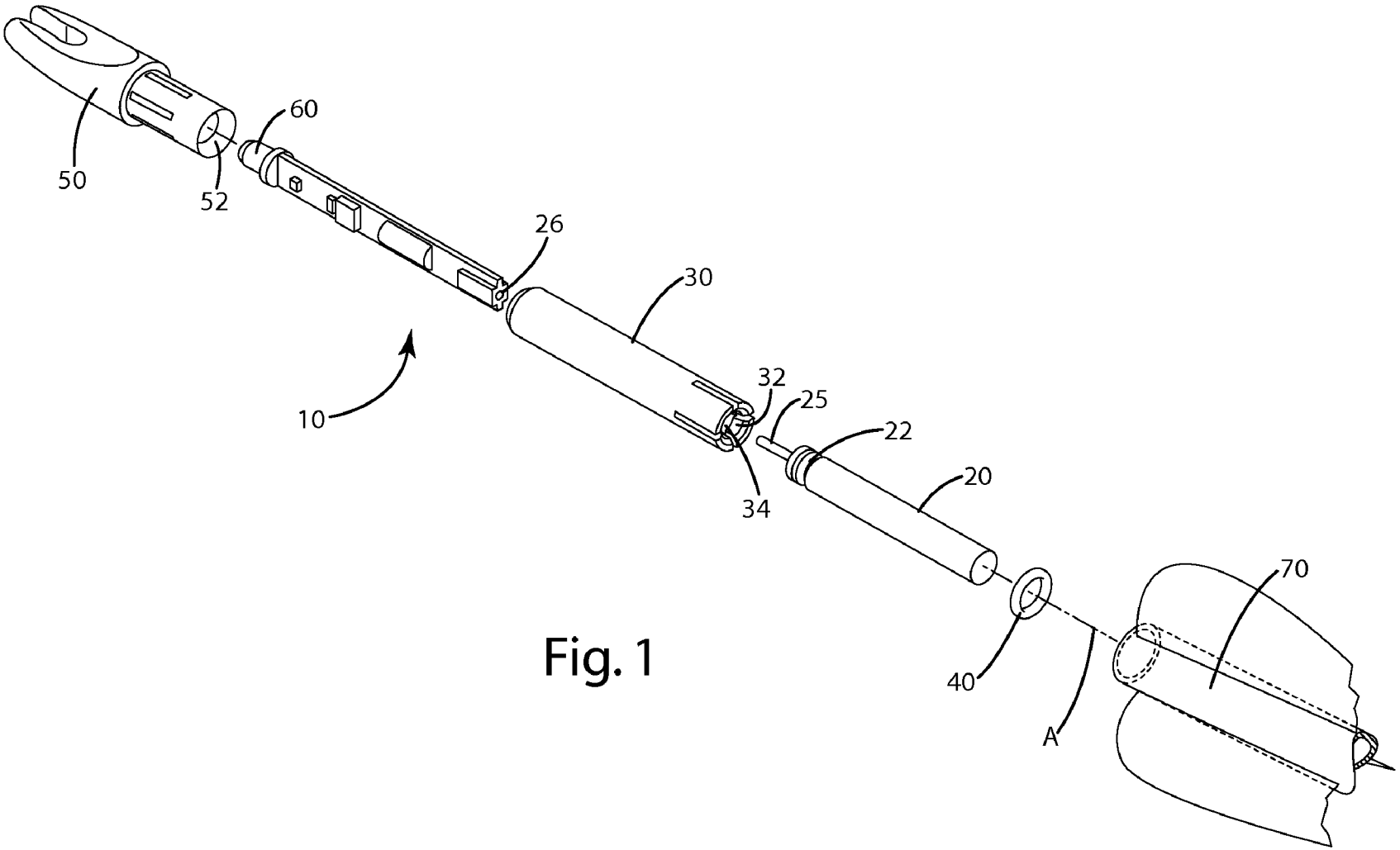
FIG. 1 is an exploded view of a nock assembly of the current embodiment of the invention.
Figure 2:
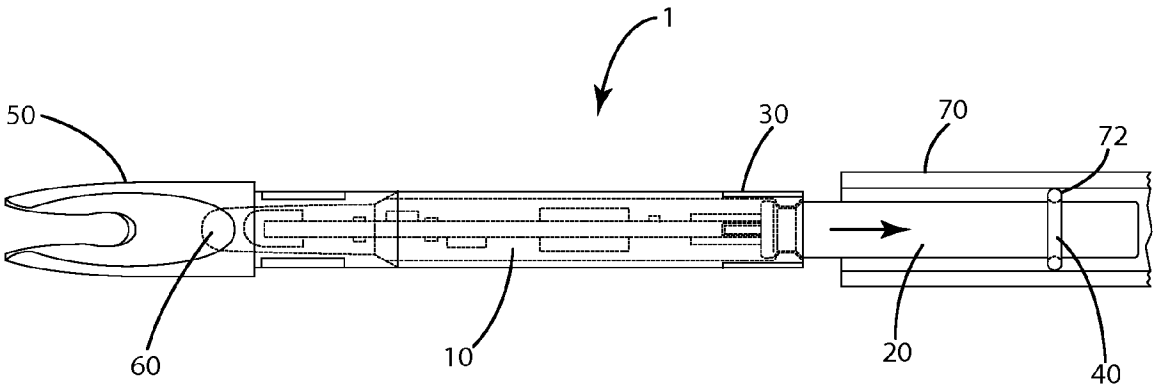
FIG. 2 is a plan view of the nock assembly of FIG. 1.

Referring to FIGS. 1 and 2, components of one embodiment of the present invention can be aligned along the axis A, the longitudinal axis of the arrow 70. There, the nock assembly 1 generally includes a housing 30, which secures or houses the circuit board 10. In alternative embodiments, the housing 30 may secure or house the arrow nock 50 in addition to or in lieu of the circuit board. The nock 50 can be constructed from a polymer, such as polycarbonate, metals, or any other materials as desired. The nock can also be translucent or transparent so that light produced by the light 60 can be transmitted therethrough. The nock 50 can further define a bore 52 into which the light 60 is fitted. In alternative embodiments, the light 60 may be positioned elsewhere on or in the nock assembly 1.

In the current embodiment, the contacts or terminals of the replaceable battery and the circuit board are axially configured. One contact 25 of the replaceable battery 20, which can be in the form of a pin or male terminal along the axis A, plugs into the circuit board contact 26, which can be in the form of a bore or female terminal along the axis A, of the circuit board 10 at the end opposite the light 60. The other contact 27 of the battery 20, which can be in the form of a surface, can be engaged by the other circuit board contact 28, which can be in the form of a pin or male terminal located radially from the bore 26. In alternative embodiments, circuit board contact 28 may be in the form of a biasing member, such as a spring 14 in electrical communication with the printed circuit board. Optionally, the spring can be a coil spring that at least partially encircles a portion of the battery 20. Other types of contacts that enable selectable electrical communication between the replaceable battery and the circuit board may be implemented. Further, in some embodiments, the circuit board may be eliminated and the light source may have electrical contacts that allow it to directly interface with the replaceable battery. An "O" ring 40 can encircle the battery 20 and serves to maintain the centrality of the battery 20 inside of the arrow shaft 70.

One suitable battery for use with the present invention is a conventional fishing float pin type battery. Such batteries can be 3.0V, and lithium based. These batteries are available from a variety of manufacturers and generally identified as CR425 batteries. Other batteries may be used as desired.

Figure 4:
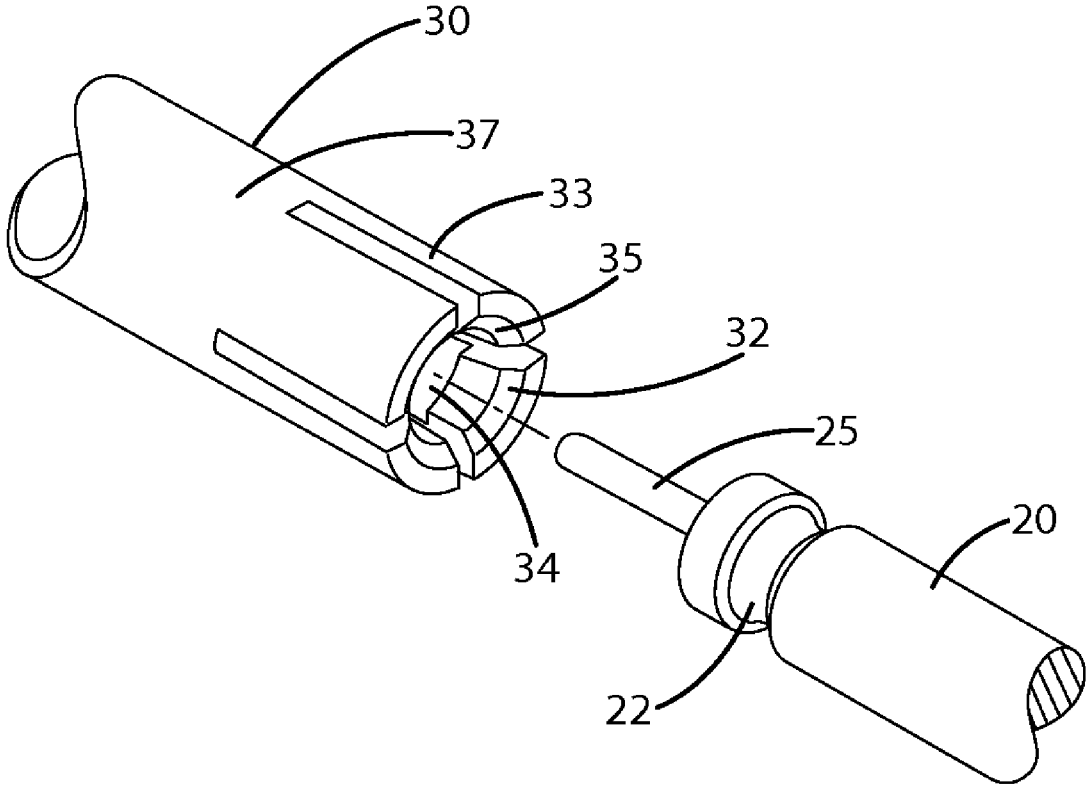
FIG. 4 is in exploded partial view of the housing 30 and the battery 20 of the nock assembly of FIG. 1.

As best seen in FIG. 4, the housing can include latching fingers or tabs 32 on the front of the housing 30. These tabs 32 can be joined with the remainder of the housing, and can define a battery holding aperture 34 into which the battery 20 is at least partially inserted. The tabs can include an elongate finger portion 33, which terminates at an inwardly protruding end projection 35 (FIG. 4). The elongate finger portion 33 can extend away from the housing, along the longitudinal axis A, and can be a desired width. Along the width, each resilient tab can be of an arcuate cross section, generally concentric with the axis A. The elongate finger portion can resiliently flex relative to the main body portion 37, outward, and away from the axis A. The projection 35 can be configured to rest within a groove of the battery 20. In general, the tabs 32 can be resilient and/or deformable so that they open slightly upon insertion of the battery into the aperture, but return to their former position to engage the annular recess 22 of the battery 20. This engagement retains the battery 20 and restrict its movement along the axis of the arrow, even when the arrow impacts a target.

The battery 20 is readily replaceable in the field, after first removing the complete nock assembly 1 from the arrow, by lifting the latching tabs 32 and/or pulling the battery 20 forward so that it is removed from the battery holding aperture 34. In this process, one contact 25 is removed from the bore 26, and the other contact 27 disengages the circuit board terminal 28. Replacement with a new battery is accomplished by simply reversing the process after ensuring that the "O" ring 40 is in place on the battery 20. Of course, other members, such as bands or spacers can substitute the "O" ring as desired. Specifically, the battery can be replaced by a user lifting the latching tabs or pulling the drained battery with sufficient force to disengage the latching tabs from the groove of the drained battery. Then, the user can insert a charged battery defining an annular groove into the archery nock assembly. The multiple latching tabs can deform, optionally bending radially outward, away from the axis A, to allow continued insertion of the charged battery. Thereafter, the latching tabs can return to their former position, engaging the annular recess of the charged battery.

Figure 3:
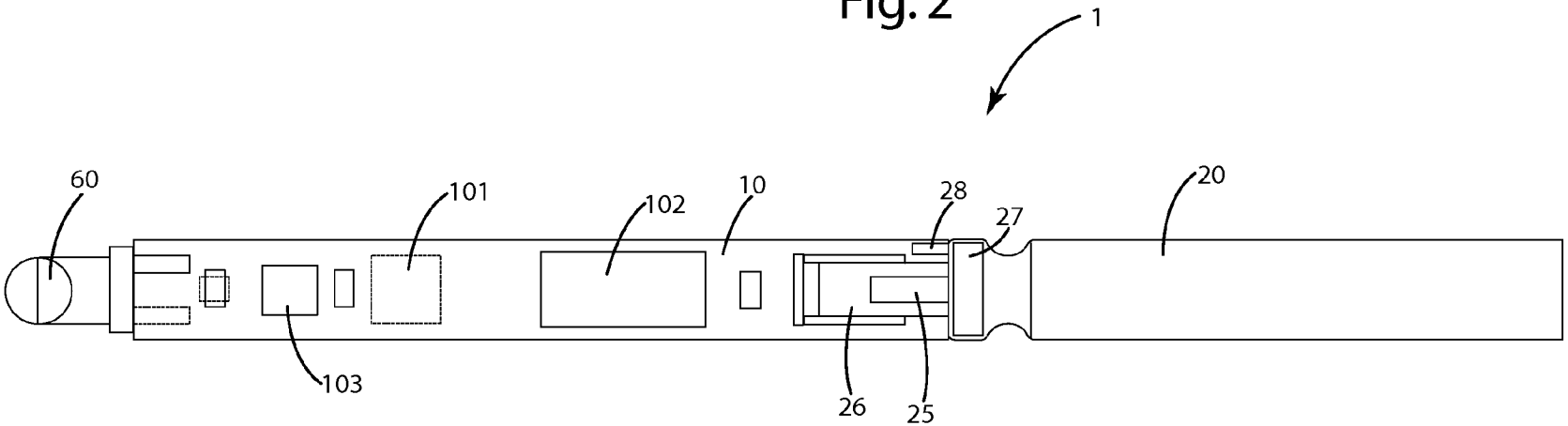
FIG. 3 is a top view of the circuit board of the nock assembly of FIG. 1.

The circuit board 10 is more detailed in FIG. 3 and FIG. 4, which depict the LED power supply 103, the microprocessor 101, the LED 60 and the battery 20. The various components are shown in their approximate relationship on the circuit board, but can be altered as desired. Further, although not shown, the circuit board 10 includes circuits which couple the various components of the assembly to enable electrical communication to or through the components to light and control the light 60 in a desired manner. Electrical communication includes, but is not limited to, direct or indirect electrical coupling or electrical connection of either power, control signals, or any other electrical signal. Optionally, each individual component can be positioned so that its center of mass is positioned on the axis A. In this manner, the nock assembly 1 is well balanced, and will not cause the arrow to which it is joined to fly erratically.

Further optionally, the microprocessor can be programmed to minimize battery drain, and therefore preserve battery life. For example, the microprocessor can pulse width modulate the LED. Due to the human eye's visual persistence, the modulation may not be visually detected. Nonetheless, operation in such a mode can result in power savings which can greatly extend the life of the battery. Pulse width modulation as used herein can encompass duty cycle modulation, or any other technique to control the amount of power transmitted to a load. Pulse width modulation may also be used to achieve an apparent higher brightness for a given power input. For example, the human eye tends to perceive peak current light levels rather than average current light levels when modulation rate of a light is higher than approximately 1000 hertz and the duty cycle is greater than 15 to 20%. In other embodiments, the microprocessor can be programmed to turn the LED on and off at predetermined, longer intervals after the arrow is shot.

Referring to FIG. 3, the accelerometer also can be located on the axis A. This accelerometer can be an acceleration switch or an integrated circuit accelerometer. Functionally, both respond to the force resulting from the acceleration of the arrow upon release. Optionally, the accelerometer can be configured to sense acceleration and/or deceleration along the axis A; however, the accelerometer can also be configured to sense acceleration or deceleration on other axes as desired.

In an embodiment where the accelerometer is an acceleration switch, the switch can be a miniature mechanical switch, either normally open or normally closed, and can respond to the application the G-force described above, or more generally to acceleration or deceleration. In this particular application, the switch is designed and sized to fit within an aperture defined by the circuit board 10 or on the surface of the circuit board. The mass of the switch also can be equally distributed about the centerline through the plane of the circuit board congruent with axis A of the arrow. Exemplary, but non-limiting suitable acceleration switches are disclosed in U.S. Pat. Nos. 7,326,867; 7,326,866; 7,067,748, as well as U.S. Provisional Patent Application 61/033,865, which are all hereby incorporated by reference in its entirety. Another suitable acceleration switch is an acceleration sensor offered under the SQ-ASX, SQ,-ASA, SQ-ASB and SQ-ASD Series, which are commercially available from SignalQuest of Lebanon, N.H. Other acceleration switches may be used as desired. Optionally, the switch can be mounted on a surface of the circuit board 10, rather than in a hole defined by the board.

In an embodiment where the accelerometer is an integrated circuit accelerometer, that accelerometer can be mounted on the circuit board in a somewhat different configuration such that the combined mass of the circuit board components is balanced about its axis. The accelerometer's response to the aforementioned G-force is primarily electrical rather than mechanical.

Whatever the accelerometer or acceleration switch chosen, the device can be used to detect a G-force exerted on the nock of about 100 Gs to about 600 Gs, and can send a signal that such a G-force has been exerted on the nock to the microprocessor so that the microprocessor can activate the LED accordingly. In the current embodiment, the accelerometer is triggered by the G forces that accompany firing a bow at a speed of about 200 to 400 feet per second. Optionally, the device also can be able to detect G-forces of about 0.1 Gs to about 10 Gs to determine when a user taps or engages the nock. Optionally, the nock can include a buffering system, such as an elastomer joined therewith, which buffers the total G-force exerted on the acceleration device. For example, the acceleration device may be rated only to operate in a range of about 5 to about 20 Gs. When the nock undergoes about 100 to about 600 Gs, the buffering system reduces the Gs transferred to the acceleration device to between about 5 to about 20 Gs, thereby enabling the device to effectively detect the 100-600 Gs, but not be overloaded by the same high G-force.

The controller, which may, for example, be a microprocessor, can receive input from a user. This input can be transferred through the accelerometer and/or another sensor associated with the nock. The accelerometer or other sensor can detect acceleration or deceleration along axes other than the longitudinal axis of the nock, which is generally aligned with the longitudinal axis of an arrow. These other axes can be axes that radiate outward from the longitudinal axis, for example, orthogonally from the longitudinal axes, or other axes. Accordingly, when a user moves the nock, for example, taps the nock against an object, the accelerometer or other sensor can detect this movement, and send a signal to the microprocessor. The microprocessor, upon detecting the signal, can operate the light of other components of the nock.

One example of tapping an arrow is to hold the arrow by one end and swing the other end of the arrow in an arc. This provides acceleration and/or deceleration along an axis other than the longitudinal axis of the arrow. Movement of the arrow, of course, generally includes movement of all of the arrow nock assembly, including the arrow nock and any other arrow nock components. Comparing the acceleration or deceleration of the movement of the nock or arrow against a predefined threshold allows the microprocessor to determine whether or not the movement amounts to a tap. The threshold may be set high so that it is difficult to accidentally tap the arrow. Alternatively, the threshold may be set low so that it is easier to tap the arrow. In some embodiments, a threshold may be set based on acceleration, in other embodiments the threshold may be set based on deceleration, in yet other embodiments both acceleration and deceleration thresholds may be set. In some embodiments, multiple thresholds may be set.

As an example, the microprocessor can detect when the nock or arrow is tapped a particular number of times by a user, and/or in a particular sequence, and accordingly, can discontinue illumination of the light. This can allow the archer to turn off the light when the arrow is retrieved. The reset function parameters, i.e. the number of taps and the interval between taps, is configurable in the initial programming of the microprocessor. As another example, the microprocessor can detect when the nock or arrow is tapped a particular number of times by a user, and/or in a particular sequence, and accordingly, can set the light to actuate continuously, in a PWM mode, in another intermittent mode, or in other modes.

The embodiments described above can feature a method of battery retention that ensures ease of battery replacement.

Optionally, the nock 50 of the nock assembly, or the light 60, can be constructed to provide an aesthetic or visual effect. Specifically, the light 60 can be an LED or other light that emits light blue in color, for example, at a wavelength interval between 430 and 510 nm, optionally between 450 and 490 nm, and further optionally at 470 nm. Alternatively or in addition, the nock can be translucent or transparent, and can transmit light from the light so that the nock 50 appears blue in color, for example, at a wavelength interval between 430 and 510 nm, optionally between 450 and 490 nm, and further optionally at 470 nm.

Figure 7:
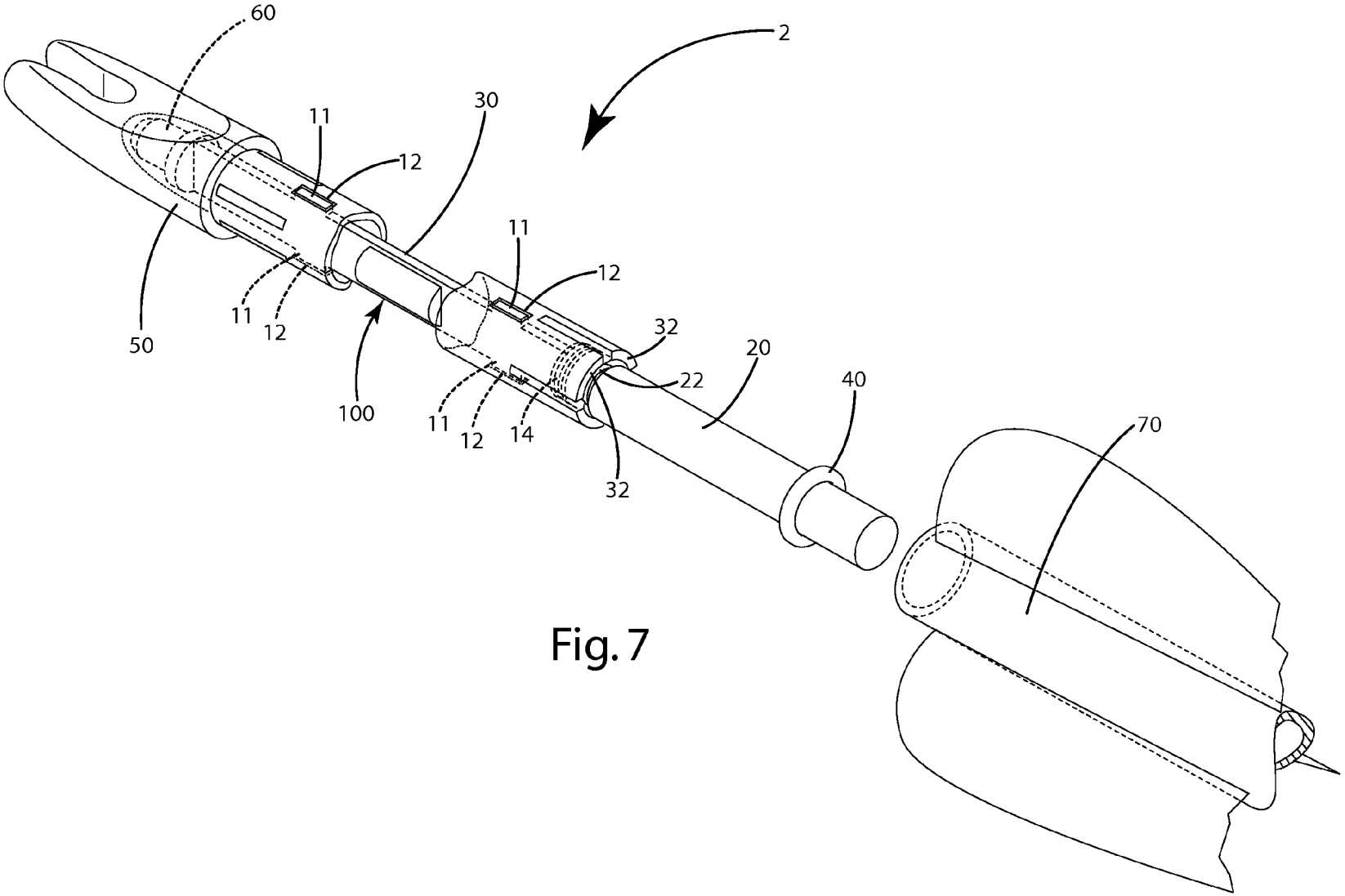
FIG. 7 is an assembled view of an alternative embodiment of the nock assembly.
Figure 8:
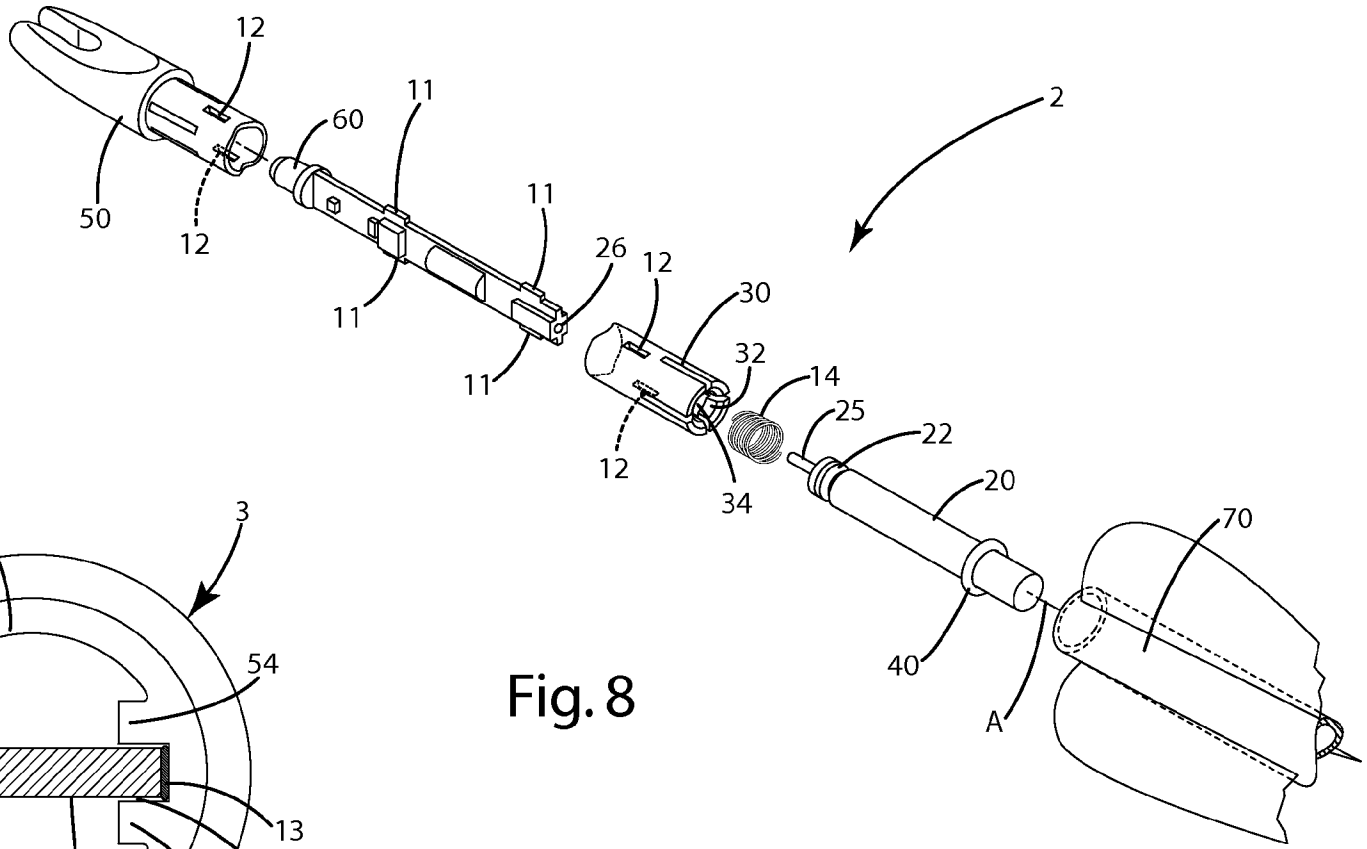
FIG. 8 is an exploded view of the nock assembly of FIG. 7.

FIGS. 7 and 8 show an alternative embodiment of the arrow nock assembly described above. The arrow nock assembly is similar to the arrow nock assembly described in connection with FIG. 1. One exception is that circuit board contact 28 is in the form of a spring in electrical communication with the printed circuit board. The spring can physically engage the battery 20, and can provide assistance for keeping the battery in place. For example, the spring can urge the battery rim 29 out from the housing to firmly lock the projections against the electrode side of the groove 22. This can provide added securement of the battery and/or reduce excessive vibration as desired.

Figure 5:
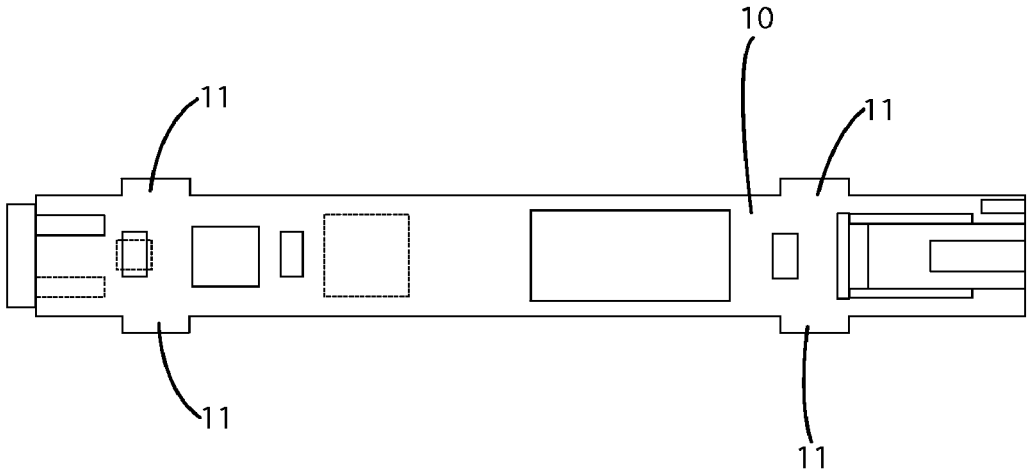
FIG. 5 is a view of an alternative embodiment of a circuit board.
Figure 6:
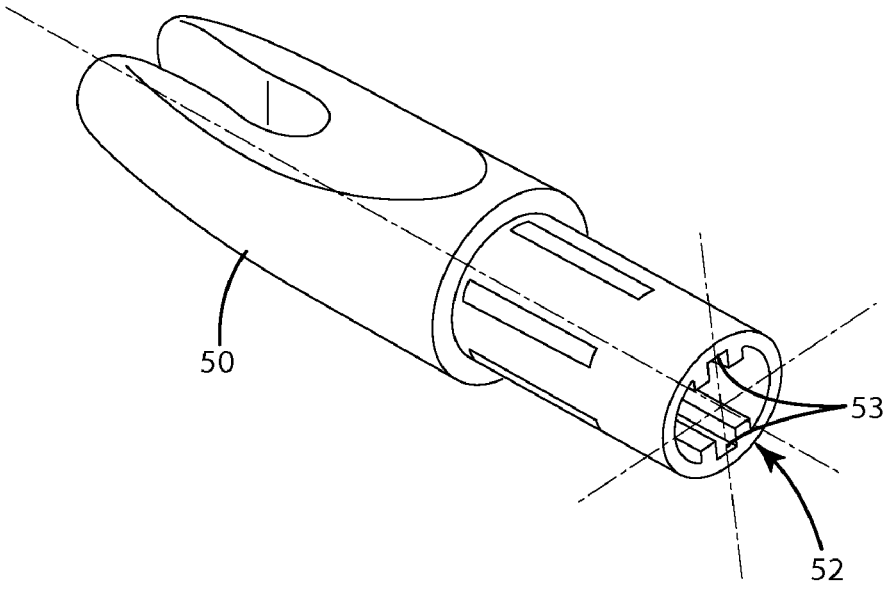
FIG. 6 is perspective view of an alternative embodiment of an archery nock.

Another difference is the tab-slot junction between the arrow nock, circuit board, and housing. FIG. 5 shows an optional configuration of the circuit board 10 depicting tabs 11 projecting from the edges of the circuit board 10. The tab can be designed to engage corresponding slots or openings 12 in the nock 50 and/or battery housing 30. As shown in FIGS. 7-8, the tabs 11 can be used to attach the circuit board 10 to the housing 30. Optionally, the circuit board can be bonded to the interior surface of the opening 52 in the nock 50 with silicone or other suitable adhesive so that the housing 30 is generally not removable from the board. Operation of these tabs 11 interfitting within the slots 12 can be seen in FIGS. 7 and 8.

Figure 9:
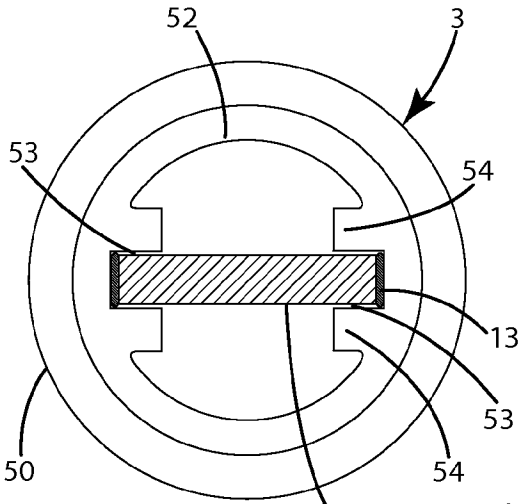
FIG. 9 is a cross-sectional view of the junction between the archery nock of claim 6 and a circuit board.

FIG. 9 illustrates in yet another embodiment, including an alternative construction to join the nock, or optionally the battery housing, with the circuit. There, projections 54 are formed on the interior surface of the opening 52 of the nock 50 (or alternatively, the battery housing) to provide grooves 53, which are optionally in an opposing configuration. The opposed edges of the circuit board 10 fit within and engage the grooves 53 of the nock 50. With the construction, the nock or battery housing is mounted in a stable configuration relative to the board. Optionally, the nock and/or housing attachment elements, e.g., the grooves or tabs in the embodiments above, can be joined with the circuit board via silicone or other suitable adhesive 13, as shown in the cross-sectional view of the junction between the circuit board and the archery nock, depicted in FIG. 9. In still another embodiment, the nock assembly 1 may be provided with a nock 50 defining an opening 52 with a smooth bore. Corresponding aligned holes can be defined in the nock 50 and the circuit board 10. In this embodiment, a device, such as a pin, can be inserted in the holes to retain the circuit board 10 in the nock 50. Optionally, for the purpose of retention, a suitable adhesive may be injected through the hole in the nock 50.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A lighted archery nock assembly for use with an arrow having a longitudinal axis, the lighted archery nock comprising:

an arrow nock having a longitudinal axis generally aligned with said longitudinal axis of said arrow;

a power source for providing power to said lighted archery nock assembly;

circuitry in electrical communication with said power source, said circuitry including:

an accelerometer that generates an accelerometer output indicative of at least one of acceleration and deceleration in response to movement of said lighted archery nock along an axis other than said longitudinal axis of said arrow nock;

a light source visible through at least a portion of said arrow nock; and a controller in electrical communication with said accelerometer for receiving said accelerometer output, said controller in electrical communication with said light source;

wherein said controller is programmed to operate said light source in response to said accelerometer output exceeding at least one of a predefined threshold acceleration of said lighted archery nock along an axis other than said longitudinal axis of said arrow nock and a predefined threshold deceleration of said lighted archery nock along an axis other than said longitudinal axis of said arrow nock; and a housing joined with at least one of said arrow nock and said circuitry.

2. The lighted arrow nock assembly of claim 1 wherein in response to said accelerometer output said controller at least one of actuates said light source continuously, pulse width modulate said light source, and deactivates said light source.

3. The lighted arrow nock assembly of claim 1 wherein said accelerometer provides a plurality of accelerometer outputs and wherein said controller is programmed to identify taps of said arrow nock as a function of said plurality of accelerometer outputs.

4. The lighted arrow nock assembly of claim 3 wherein said controller operates said light source as a function of said taps of said arrow nock.

5. The lighted arrow nock assembly of claim 4 wherein operation of said controller is programmable as a function of said taps of said arrow nock.

6. The lighted arrow nock assembly of claim 1 wherein said accelerometer generates said accelerometer output in response to movement of said lighted archery nock along a substantially orthogonal axis to said longitudinal axis.

7. The lighted arrow nock assembly of claim 1 wherein said circuitry includes a sensor, said controller is in electrical communication with said sensor, and said controller is programmed to operate said light source as a function of said sensor.

8. A lighted archery nock assembly comprising:

an arrow nock having a longitudinal axis generally aligned with the longitudinal axis of an arrow;

a power source;

circuitry in electrical communication with said power source, said circuitry including:

an accelerometer that provides an accelerometer output indicative of at least one of acceleration and deceleration of said lighted archery nock along an axis other than said longitudinal axis of said arrow nock;

a light source;

a controller electrically coupled to said accelerometer and said light source, wherein said controller is programmed to operate said circuitry as a function of said accelerometer output.

9. The lighted arrow nock assembly of claim 8 wherein in response to said accelerometer output said controller at least one of actuates said light source continuously, pulse width modulate said light source, and deactivates said light source.

10. The lighted arrow nock assembly of claim 8 wherein said accelerometer generates a plurality of accelerometer outputs and wherein said controller is programmed to identify taps of said arrow nock as a function of said plurality of accelerometer outputs.

11. The lighted arrow nock assembly of claim 10 wherein said controller operates said light source as a function of said taps of said arrow nock.

12. The lighted arrow nock assembly of claim 11 wherein operation of said controller is programmable as a function of said taps of said arrow nock.

13. The lighted arrow nock assembly of claim 8 wherein said accelerometer generates said accelerometer output in response to movement of said lighted archery nock along a substantially orthogonal axis to said longitudinal axis.

14. The lighted arrow nock assembly of claim 8 wherein said circuitry includes a sensor, said controller is in electrical communication with said sensor, and said controller is programmed to operate said light source as a function of said sensor.

15. A method for re-setting a light source in a lighted archery nock assembly joined with an arrow having a longitudinal axis, the method comprising:

moving the arrow along an axis other than said longitudinal axis of the arrow;

sensing at least one of acceleration and deceleration of said arrow along the axis other than the longitudinal axis of the arrow;

comparing the at least one of acceleration and deceleration of said arrow to a predetermined threshold indicative of the amount of G forces that accompany tapping an arrow by a user;

re-setting the light source in the lighted archery nock assembly in response to an indication that at least one of acceleration and deceleration of said arrow exceeds said predetermined threshold.

16. The method for re-setting a light source of claim 15 wherein said re-setting comprises at least one of actuating said light source continuously, pulse width modulating said light source, and deactivating said light source.

17. The method for re-setting a light source of claim 15 wherein moving the arrow comprises moving the arrow along an axis substantially orthogonal to said longitudinal axis of said arrow.

18. The method for re-setting a light source of claim 15 wherein said sensing comprises sensing a series of readings and said comparing comprises identifying taps of said arrow as a function of said readings.

19. The method for re-setting a light source of claim 18 wherein re-setting comprises de-activating said light source as a function of said taps of said arrow nock.

* * * * *